US006644825B2

(12) United States Patent
Lin

(10) Patent No.: US 6,644,825 B2
(45) Date of Patent: Nov. 11, 2003

(54) NAIL-DRIVING TOOL WITH AN ILLUMINATION DEVICE

(76) Inventor: Hwai-Tay Lin, Akara Building, 24 De Castro Street, Wickhams Cay I, Road Town, Tortola (VG)

( * ) Notice: Subject to any disclaimer, the term of this patent is extended or adjusted under 35 U.S.C. 154(b) by 0 days.

(21) Appl. No.: 09/991,722

(22) Filed: Nov. 19, 2001

(65) Prior Publication Data

US 2003/0095402 A1 May 22, 2003

(51) Int. Cl.[7] ..... B25B 23/18

(52) U.S. Cl. ..... 362/119; 362/109; 362/120; 362/203; 362/204; 362/205; 362/253

(58) Field of Search ..... 362/119, 203, 362/204, 253, 205, 109, 120; 227/10

(56) References Cited

U.S. PATENT DOCUMENTS 3,967,771 A * 7/1976 Smith ..... 227/10
5,072,341 A * 12/1991 Huang ..... 362/96
5,628,556 A * 5/1997 Hrabar et al. ..... 362/578

* cited by examiner

*Primary Examiner*—Sandra O'Shea
*Assistant Examiner*—Mark Tsidulko
(74) *Attorney, Agent, or Firm*—Alan D. Kamrath; Rider Bennett, LLP.

(57) ABSTRACT

A nail-driving tool includes a body and an illumination device detachably mounted to the body. The body includes a plurality of engaging members formed thereon, and the illumination device includes a casing having an engaging groove for releasably engaging with one of the engaging members of the body.

15 Claims, 8 Drawing Sheets

A - A

B - B

NAIL-DRIVING TOOL WITH AN ILLUMINATION DEVICE

BACKGROUND OF THE INVENTION

1. Field of the Invention

The present invention relates to a nail-driving tool with an illumination device.

2. Description of the Related Art

Nail-driving tools are well known and have become a crowded art. Most improvements in the nail-driving tools result from user needs. When using a nail-driving tool in a space delimited by plywood or the like, it is often difficult for the user to clearly see the position of the nail-driving tool, as the space is dark. Thus, the user often has to grope in the dark and thus does poor work. The present invention is intended to provide an illumination device for a nail-driving tool to solve this problem.

SUMMARY OF THE INVENTION

An object of the present invention is to provide a nail-driving tool with an illumination device to provide illumination while working.

A nail-driving tool in accordance with the present invention comprises a body and an illumination device detachably mounted to the body. The body comprises at least one engaging member formed thereon, and the illumination device comprises a casing having an engaging groove for releasably engaging with the engaging member on the body. In a preferred embodiment of the invention, the body comprises a plurality of engaging members formed thereon, and the illumination device comprises a casing having an engaging groove for releasably engaging with one of the engaging members of the body.

Other objects, advantages, and novel features of the invention will become more apparent from the following detailed description when taken in conjunction with the accompanying drawings.

BRIEF DESCRIPTION OF THE DRAWINGS

FIG. 3B is a view similar to FIG. 3A, wherein the illumination device is turned on.

DETAILED DESCRIPTION OF THE PREFERRED EMBODIMENTS

Figure 1:
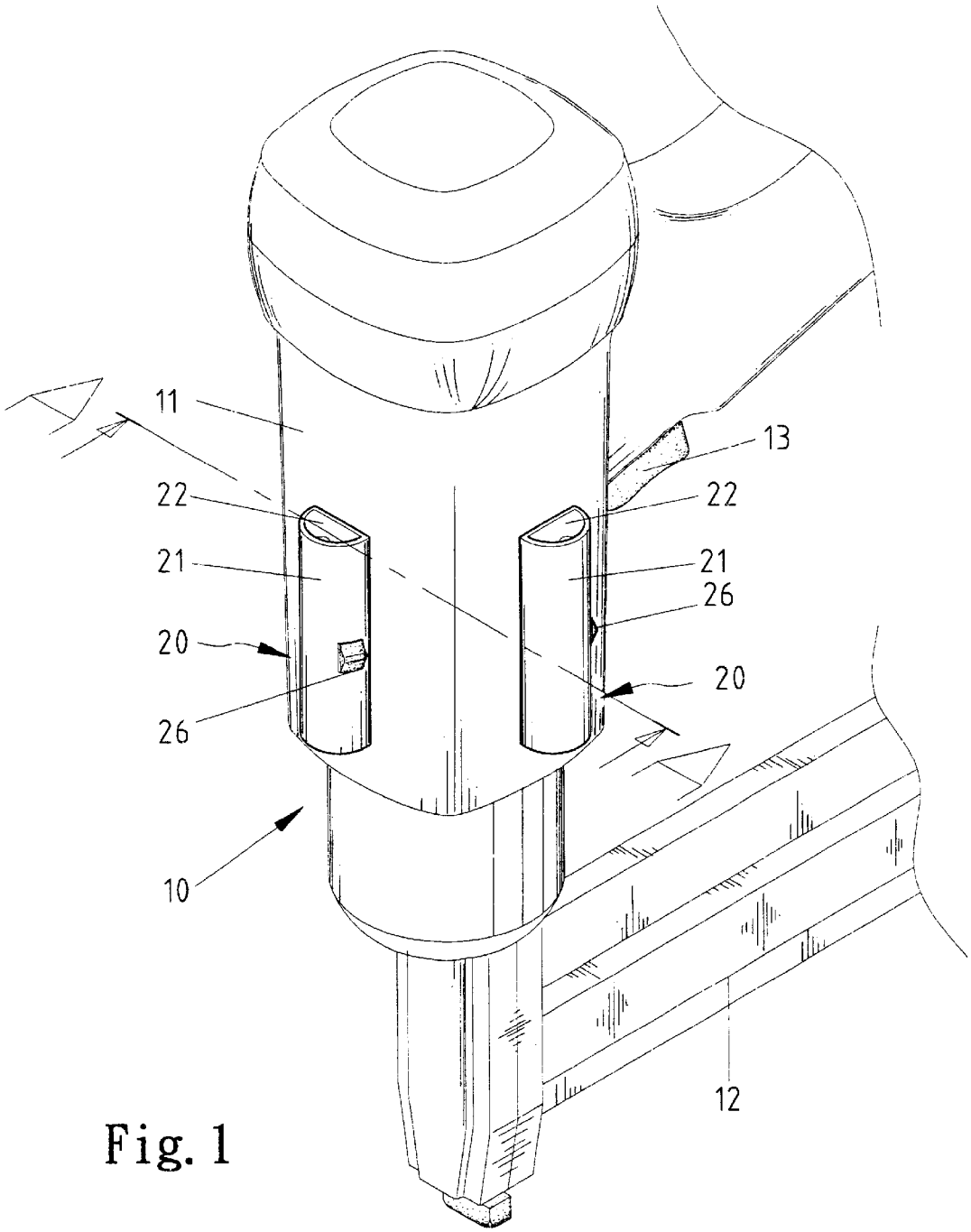
FIG. 1 is a perspective view of a portion of a nail-driving tool in accordance with the present invention.
Figure 2:
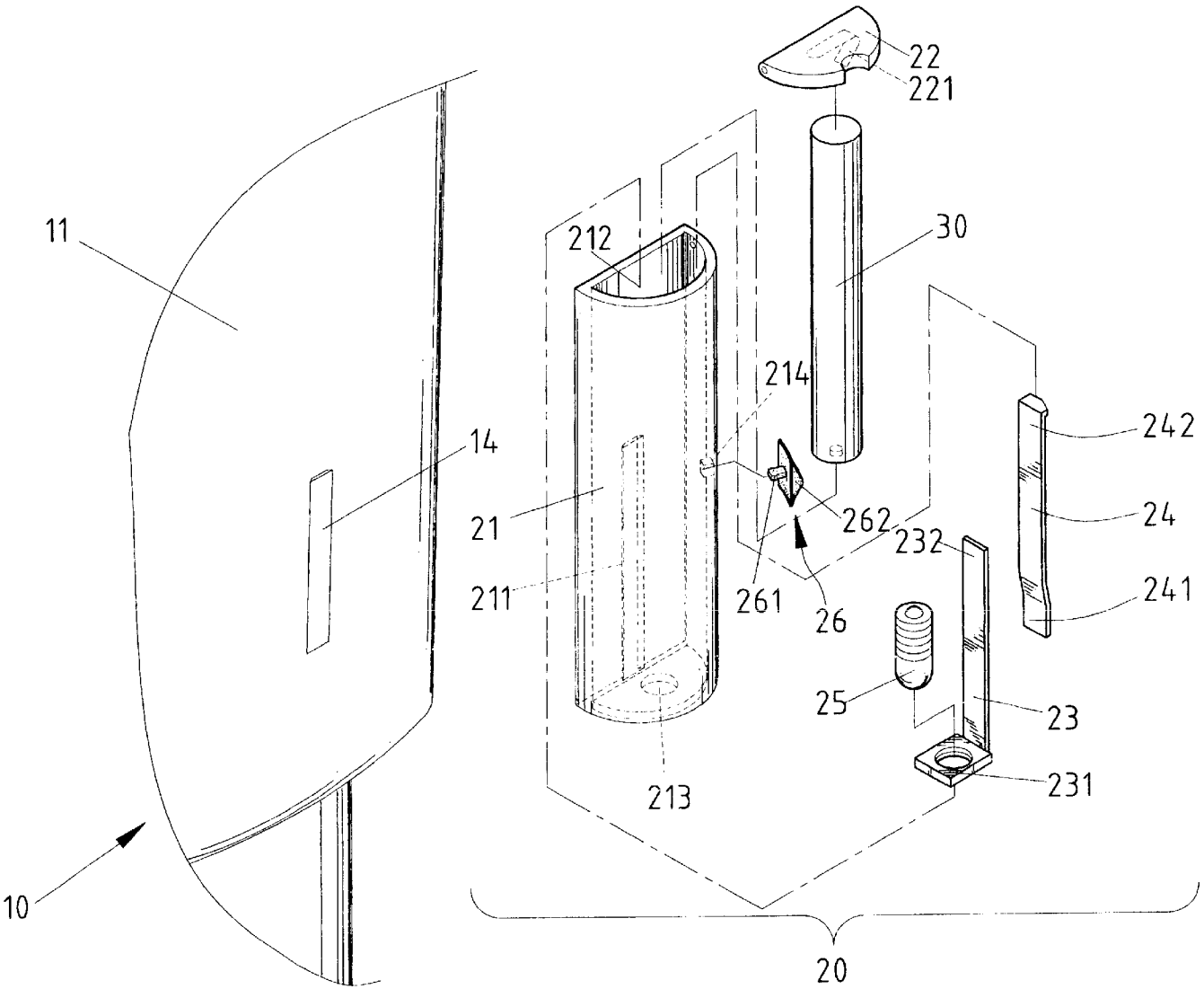
FIG. 2 is an exploded perspective view of an illumination device of the nail-driving tool in accordance with the present invention.
Figure 3A:
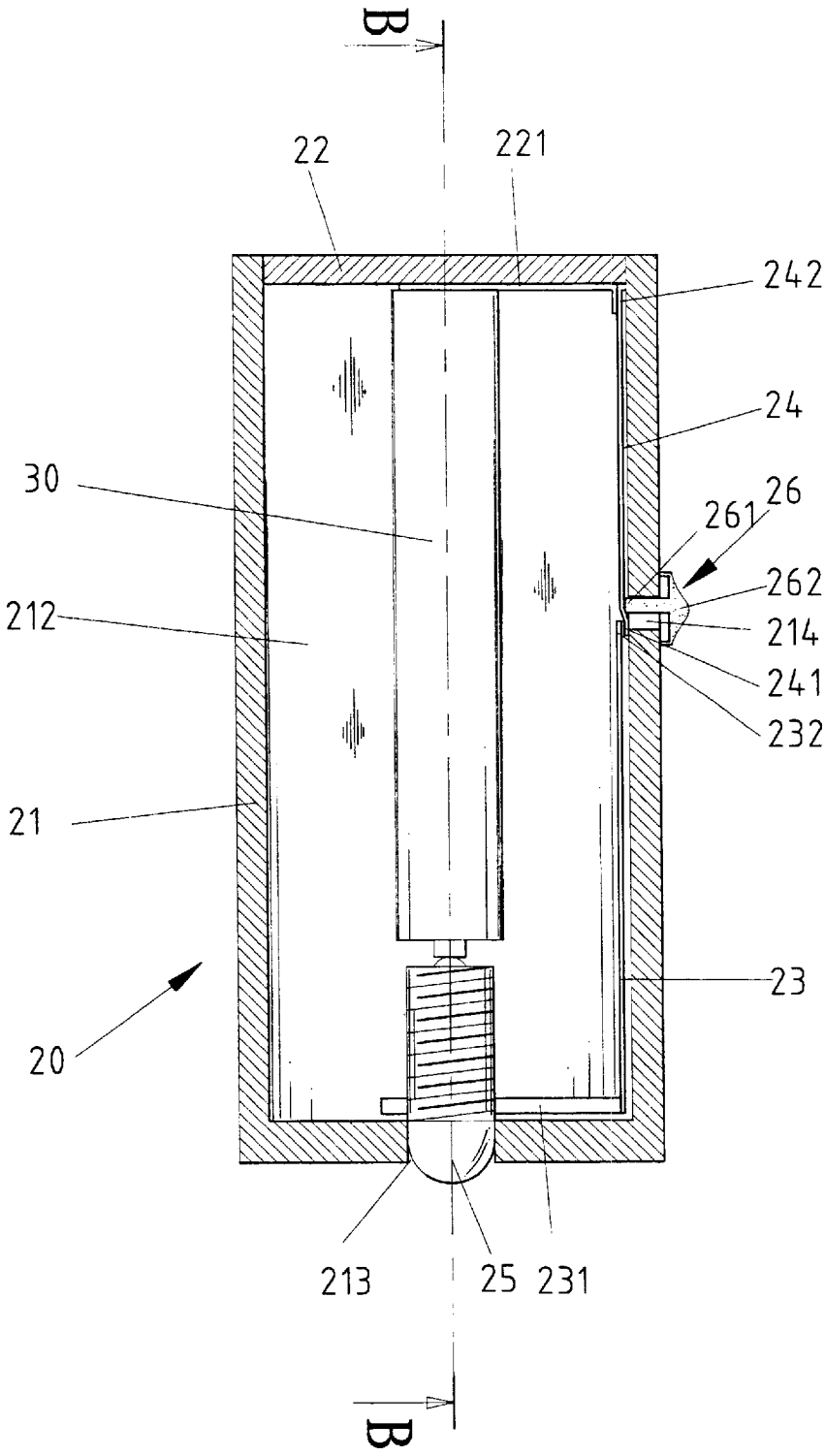
FIG. 3A is a sectional view taken along plane A—A in FIG. 1.
Figure 3B:
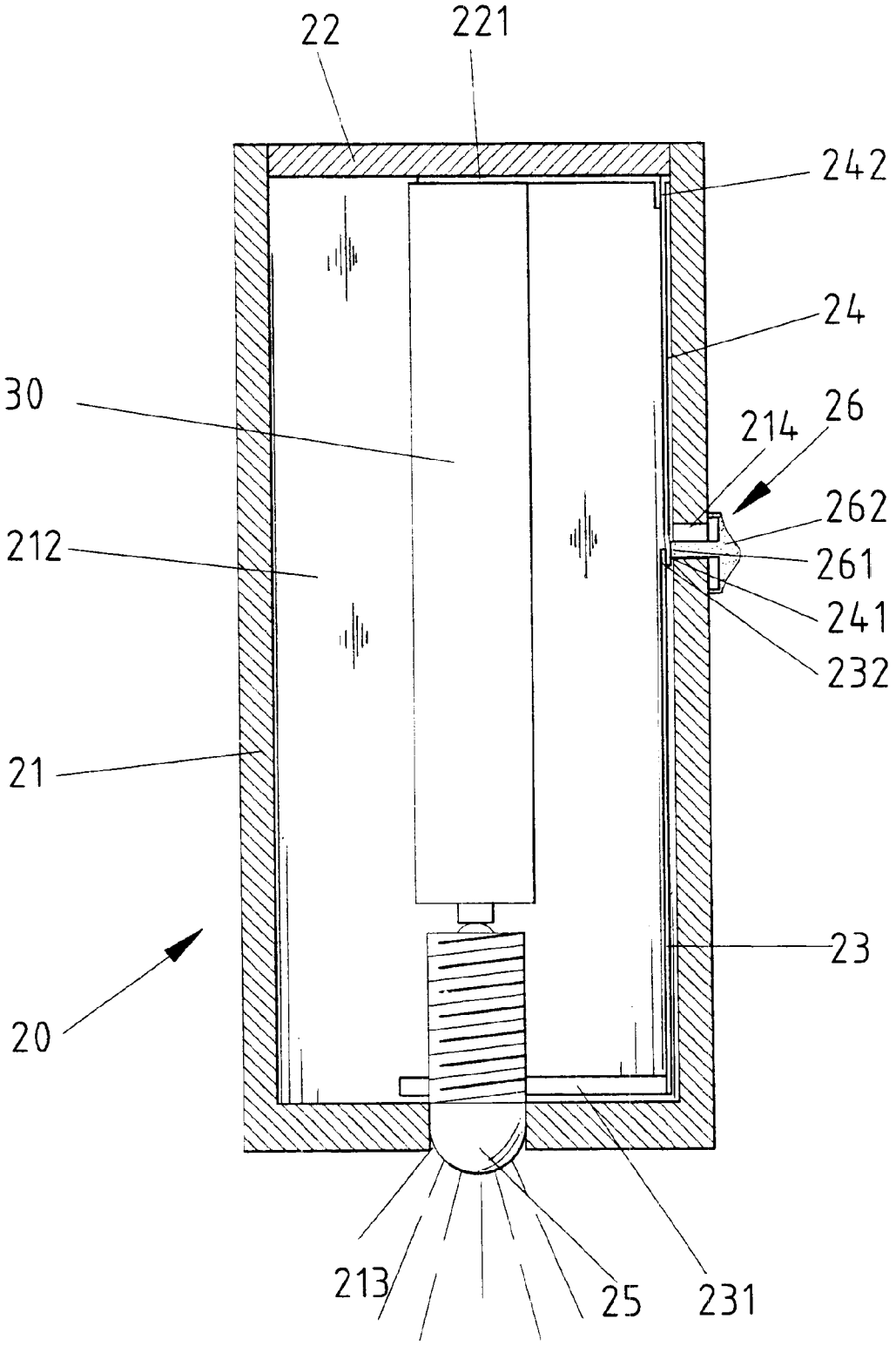
Figure 4:
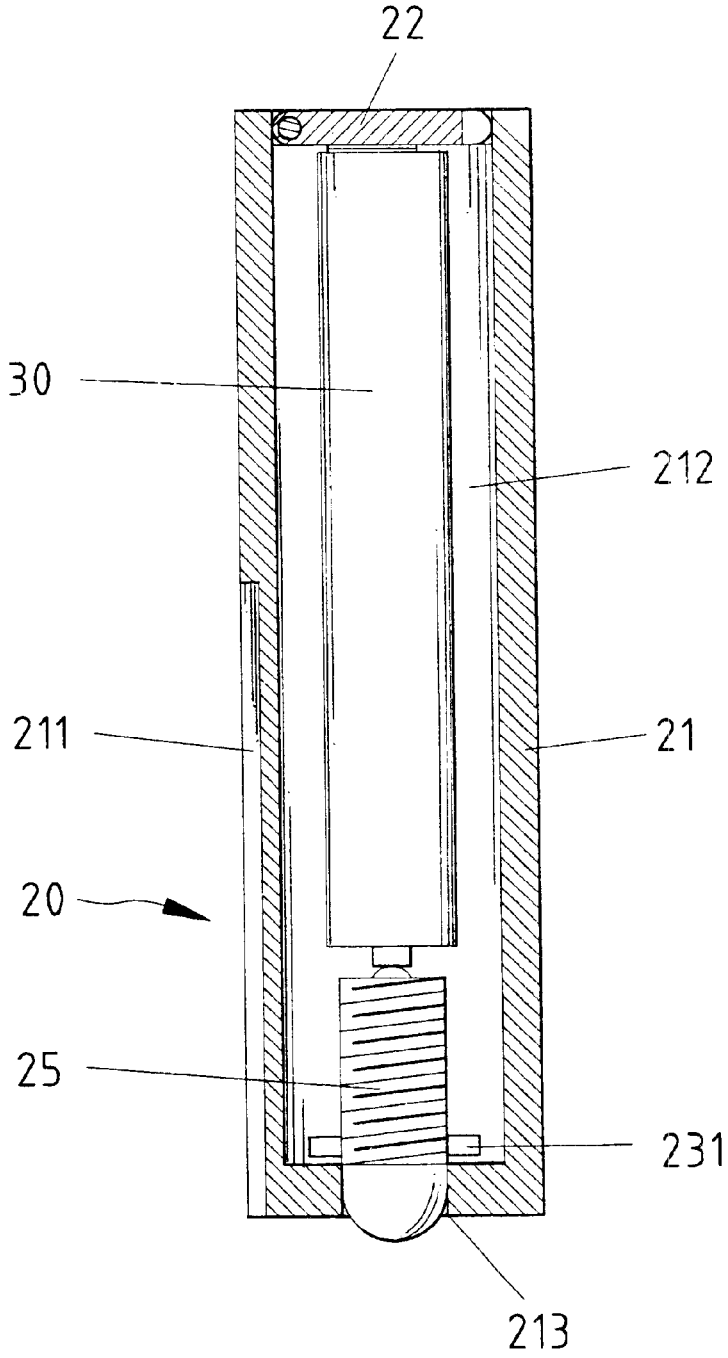
FIG. 4 is a sectional view taken along plane B—B in FIG. 1.

Referring to FIGS. 1 through 5 and initially to FIGS. 1, 2, and 4, a nail-driving tool 10 in accordance with the present invention generally includes a body 11 and a magazine 12. A valve-operated mechanism (not shown) is mounted in the body 11 to drive a nail from the magazine 12 out of the body 11 when a trigger 13 on the body 11 is triggered. Such an arrangement is conventional and therefore not described in detail.

At least one engaging member 14 is mounted on the body 11. In a preferred embodiment of the invention, the engaging member 14 is a dovetail block. An illumination device 20 is detachably mounted to the body 11. In this embodiment, the illumination device 20 comprises a casing 21, a lid 22, a switch 26, a bulb 25, a first conductive plate 23, and a second conductive plate 24.

The casing 21 comprises an engaging groove 211 (preferably a dovetail groove) in an outer periphery thereof for engaging with the engaging member 14 on the nail-driving tool 10. Thus, the illuminating device 20 can be detachably mounted to any desired position on the nail-driving tool 10 only if there is an engaging member 14 provided in the desired position. Namely, the nail-driving tool 10 may include as many engaging members 14 as required. The casing 21 comprises a compartment 212 having a first end with an end wall in which a hole 213 is defined and an open second end that is closed by the lid 22. The casing 21 further includes a transverse hole 214.

Referring to FIGS. 2 and 3A, the first conductive plate 23 is mounted in the compartment 212 and comprises a first end having a bulb seat 231 for receiving the bulb 25 and a second end 232. The second conductive plate 24 is mounted in the compartment 212 and comprises a first end 241 facing the transverse hole 214 of the casing 21 and a second end 242. The first end 241 of the second conductive plate 24 is located between the transverse hole 214 of the casing 21 and the second end 232 of the first conductive plate 23. The lid 22 is mounted to close the open second end of the compartment 212 of the casing 21 and comprises a conductive plate 221 in electrical connection with the second end 242 of the second conductive plate 24. The switch 26 comprises an inner end 261 extending through the transverse hole 214 so as to be operably connected to the first end 241 of the second conductive plate 24 and an outer end 262 outside the casing 21 for manual operation. The bulb 25 is mounted in the bulb seat 231 of the first conductive plate 23 and extends through the hole 213 of the casing 21. A battery 30 is mounted between the conductive plate 221 on the lid 22 and the bulb 25.

The switch 26 of the illumination device in FIG. 3A is in an off position. The switch 26 can be moved in the transverse hole 214 of the casing 21 to an on position shown in FIG. 3B, in which the first end 241 of the second conductive plate 24 is moved to a place in electrical contact with the second end 232 of the first conductive plate 23. A closed circuit is thus created and the bulb 25 lights to provide required illumination.

Figure 5:
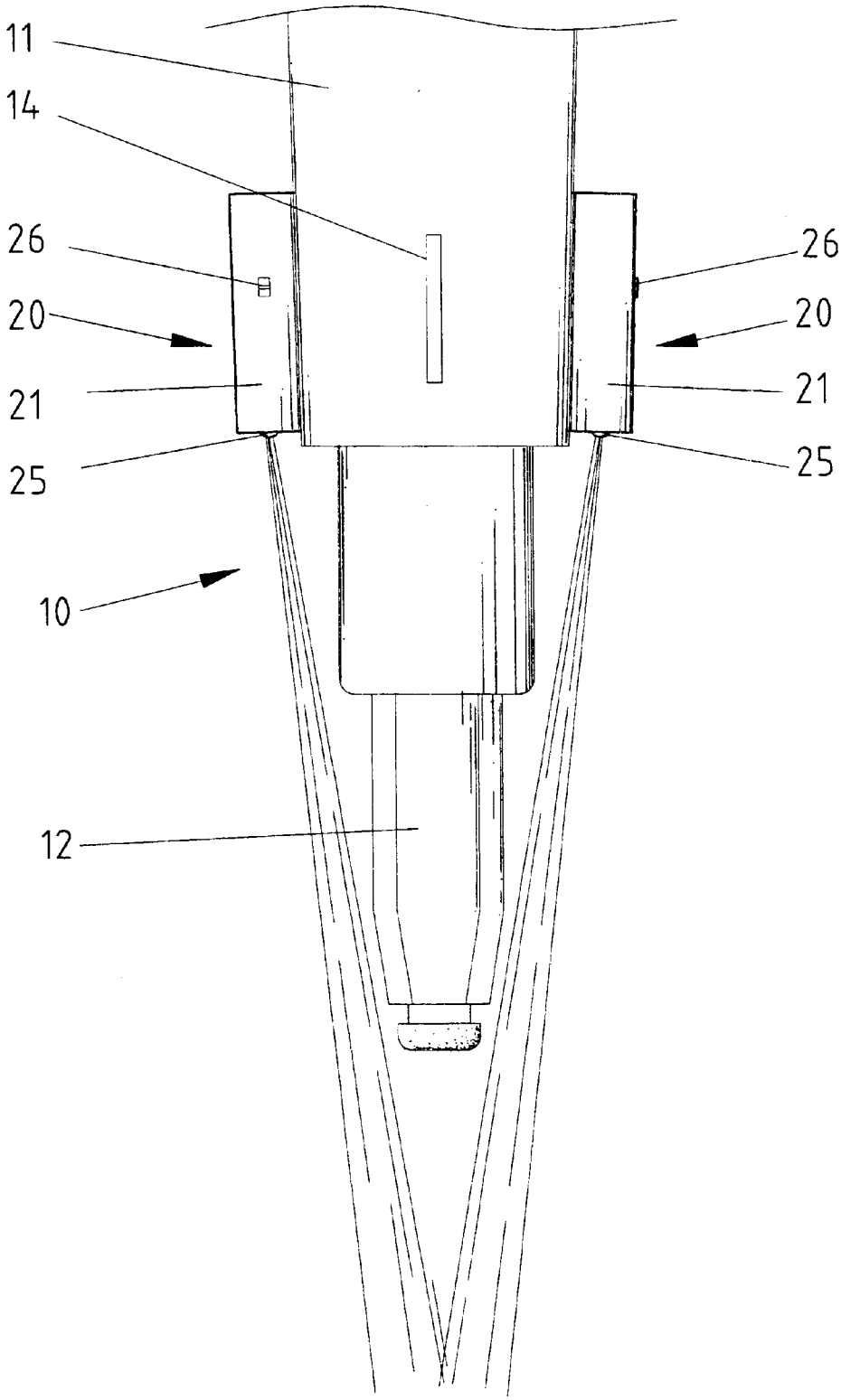
FIG. 5 is a schematic view illustrating use of the nail-driving tool in accordance with the present invention.
Figure 6:
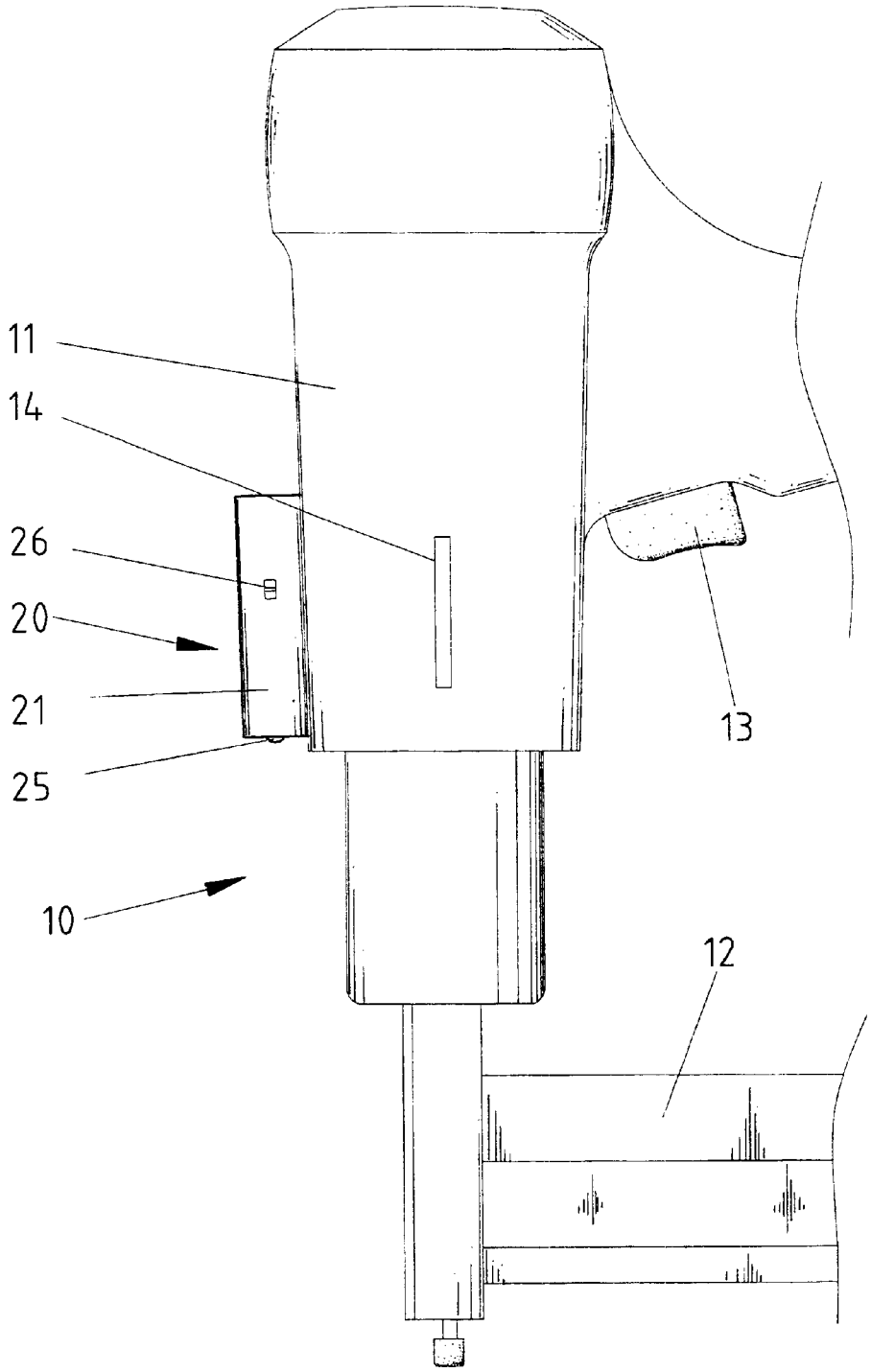
FIG. 6 is a schematic side view illustrating a modified embodiment of the nail-driving tool in accordance with the present invention.
Figure 7:
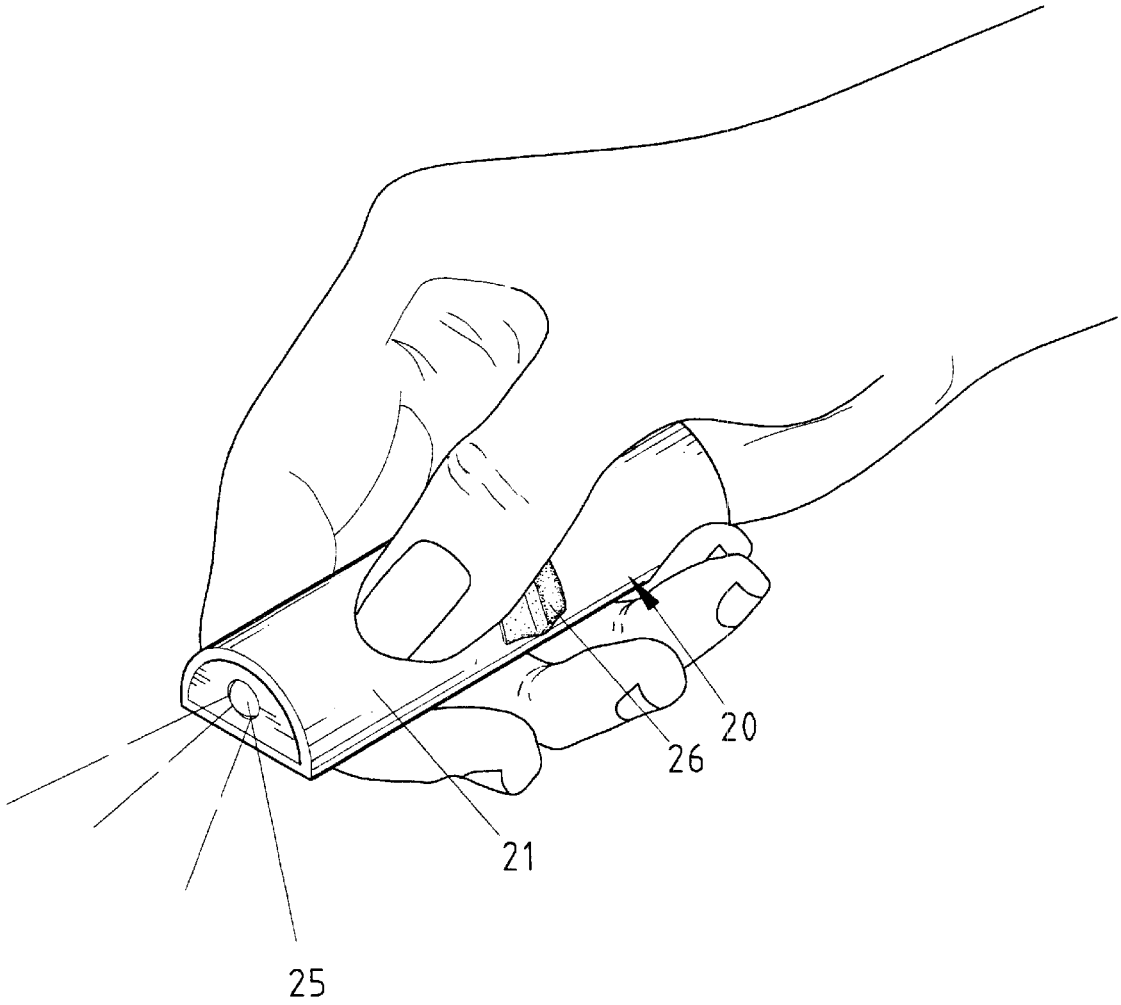
FIG. 7 is a perspective view illustrating separate use of the illumination device.

Referring to FIG. 5, the illumination device 20 can be attached to any desired position on the body 11 of the nail-driving tool 10 to suit both a right-handed user and a left-handed user. Referring to FIG. 6, the illumination device 20 can be mounted on top of the body 11 when used in a limited space. Referring to FIG. 7, the illumination device 20 can be detached from the body 11 for separate use.

Although the invention has been explained in relation to its preferred embodiment, it is to be understood that many other possible modifications and variations can be made without departing from the scope of the invention as hereinafter claimed.

What is claimed is:

1. A nail-driving tool comprising:

a magazine for receiving a plurality of nails;

a body;

a trigger on the body, with one of the plurality of nails being driven from the body when the trigger on the body is triggered; and an illumination device mounted to the body and providing illumination, with the illumination device comprising a casing including an outer periphery having an engaging groove for releasably engaging with the body such that the illumination device is located outside of the body.

2. The nail-driving tool as claimed in claim 1, wherein the body comprises an outer periphery having at least one engaging member formed on the outside of the outer periphery, with the engaging groove releasably engaging with said at least one engaging member on the body such that the illumination device is located on the outer periphery of the body.

3. The nail-driving tool as claimed in claim 2, wherein said at least one engaging member is a dovetail member, and wherein the engaging groove of the casing is a dovetail groove.

4. The nail-driving tool as claimed in claim 1, wherein the body comprises an outer periphery having a plurality of engaging members formed on the outside of the outer periphery, with the engaging groove releasably engaging with one of the engaging members of the body such that the illumination device is located on the outer periphery of the body.

5. The nail-driving tool as claimed in claim 4, wherein each said engaging member is a dovetail member, and wherein the engaging groove of the casing is a dovetail groove.

6. A nail-driving tool comprising:

a body; and an illumination device mounted to the body and comprising a casing, wherein the casing comprises a first end and an open second end, a hole being defined in the first end of the casing for receiving a bulb, a first conductive plate having a first end in electrical connection with the bulb and a second end, a second conductive plate having a first end and a second end, a lid being mounted to close the open second end of the casing and having a third conductive plate in electrical connection with the second end of the second conductive plate, a switch having an inner end in the casing and an outer end outside the casing for manual operation, wherein the second end of the first conductive plate is in electrical connection with the first end of the second conductive plate when the switch is in an on position, and wherein the second end of the first conductive plate is not in electrical connection with the first end of the second conductive plate when the switch is in an off position.

7. The nail-driving tool as claimed in claim 6, wherein the casing comprises a transverse hole through which the inner end of the switch extends into the casing.

8. The nail-driving tool as claimed in claim 6 with the illumination device being detachably mounted to the body.

9. The nail-driving tool as claimed in claim 8, wherein the body comprises at least one engaging member formed thereon, with the casing having an engaging groove for releasably engaging with said at least one engaging member on the body.

10. The nail-driving tool as claimed in claim 9, wherein said at least one engaging member is a dovetail member, and wherein the engaging groove of the casing is a dovetail groove.

11. The nail-driving tool as claimed in claim 8, wherein the body comprises a plurality of engaging members formed thereon, with the casing having an engaging groove for releasably engaging with one of the engaging members of the body.

12. The nail-driving tool as claimed in claim 11, wherein each said engaging member is a dovetail member, and wherein the engaging groove of the casing is a dovetail groove.

13. The nail-driving tool as claimed in claim 4, wherein the outer periphery of the casing defines an interior having a first end and a second end, with the illuminating device comprising a bulb and a battery, with the battery located in the interior and accessible through the second end, with the bulb located adjacent to the first end, with the engaging groove located between the first and second ends.

14. The nail-driving tool as claimed in claim 2, wherein the outer periphery of the casing defines an interior having a first end and a second end, with the illuminating device comprising a bulb and a battery, with the battery located in the interior and accessible through the second end, with the bulb located adjacent to the first end, with the engaging groove located between the first and second ends.

15. The nail-driving tool as claimed in claim 1, wherein the casing defines an interior having a first end and a second end, with the body having at least one engaging member outside of the interior and between the first and second ends, with the illuminating device comprising a bulb and a battery, with the battery located in the interior and accessible through the second end, with the bulb located adjacent to the first end.

* * * * *